US005080191A

United States Patent [19]

Sanchez

[11] Patent Number: 5,080,191

[45] Date of Patent: Jan. 14, 1992

[54] SPORTS HARNESS

[76] Inventor: George S. Sanchez, 3603 Eliot St., Denver, Colo. 80211

[21] Appl. No.: 605,784

[22] Filed: Oct. 30, 1990

[51] Int. Cl.[5] ..... A62B 35/00

[52] U.S. Cl. ..... 182/3; 297/465; 280/801; 244/151 R

[58] Field of Search ..... 182/3; 119/96, 101; 297/465, 464, 467, 484, 485; 280/801; 244/151 R

[56] References Cited

U.S. PATENT DOCUMENTS

| | | | |
|---|---|---|---|
| 2,141,041 | 12/1938 | Knight | 244/151 R |
| 2,461,347 | 2/1949 | Pentecost | 182/3 X |
| 2,475,631 | 7/1949 | Miller et al. | 244/151 R |
| 3,154,272 | 10/1964 | Gold | 244/151 R |
| 3,424,134 | 1/1969 | Rosenblum | 119/96 |
| 3,452,374 | 7/1969 | Turner | 244/151 R |
| 3,559,932 | 2/1971 | Ternes | 244/151 R |
| 4,226,474 | 10/1980 | Rupert et al. | 297/465 X |
| 4,512,437 | 4/1985 | Savage | 244/151 R |
| 4,720,064 | 1/1988 | Herndon | 244/151 R X |
| 4,746,084 | 5/1988 | Strong | 244/151 R |
| 4,923,149 | 5/1990 | Feher | 244/151 R |
| 4,927,211 | 5/1990 | Bolcerek | 297/467 X |
| 4,938,436 | 7/1990 | Bradley et al. | 244/151 R |

*Primary Examiner*—Reinaldo P. Machado
*Assistant Examiner*—Korie H. Chan
*Attorney, Agent, or Firm*—Gary M. Polumbus

[57] ABSTRACT

A harness for use by adults or children in learning certain sporting activities such as snow skiing is disclosed in two embodiments wherein handles are conveniently disposed for gripping by individuals helping a user of the harness. Anchors are also provided on the harness to releasably attach the harness to a sit ski and other anchors are provided to which tether lines can be attached for use by an individual assisting the user of the harness in snow skiing or the like. The harness is further provided with unique means for positively positioning the harness on a user for optimal control.

14 Claims, 3 Drawing Sheets

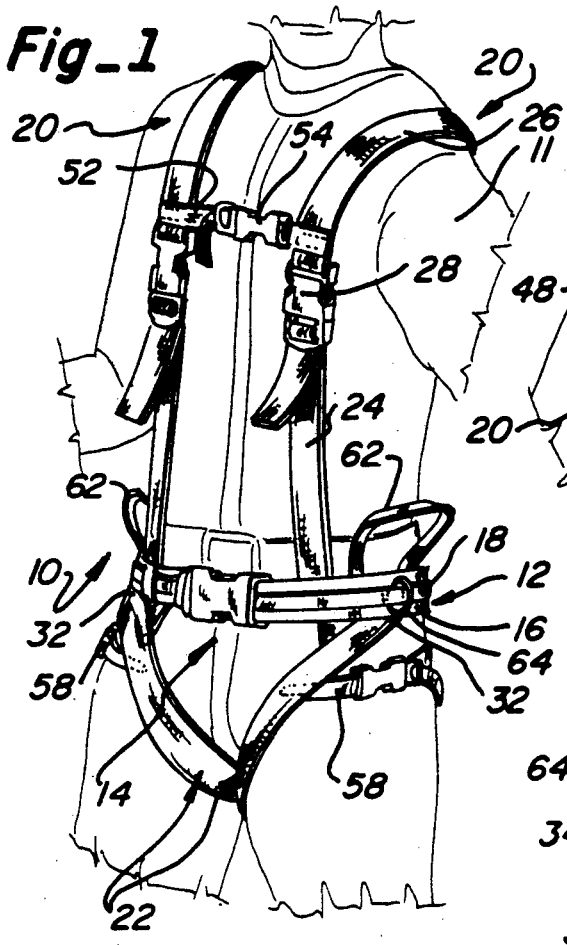
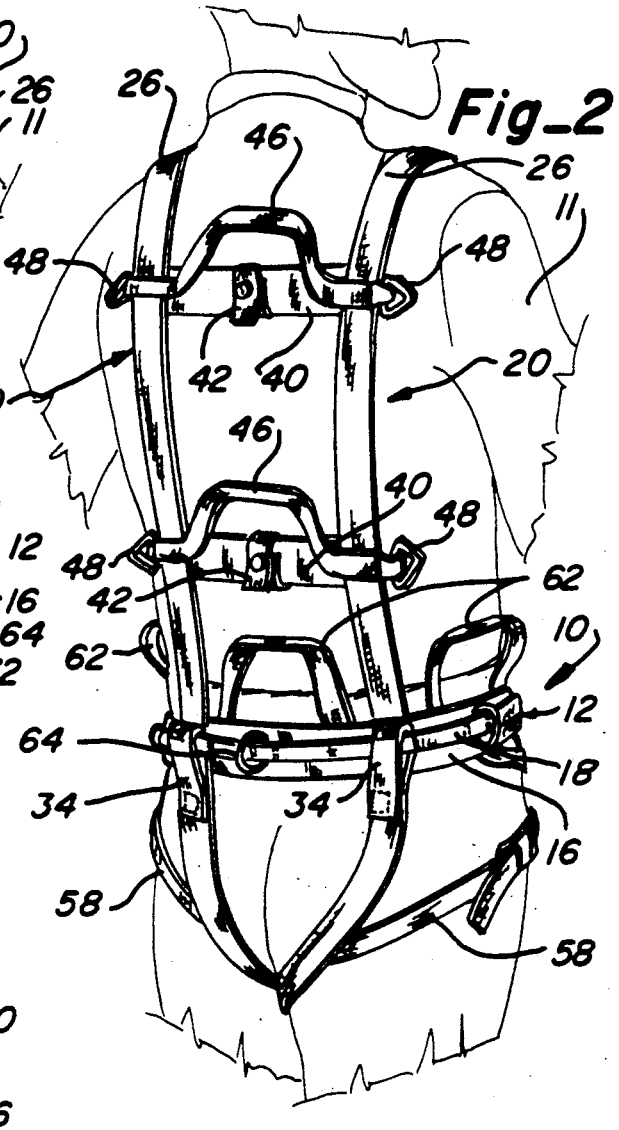
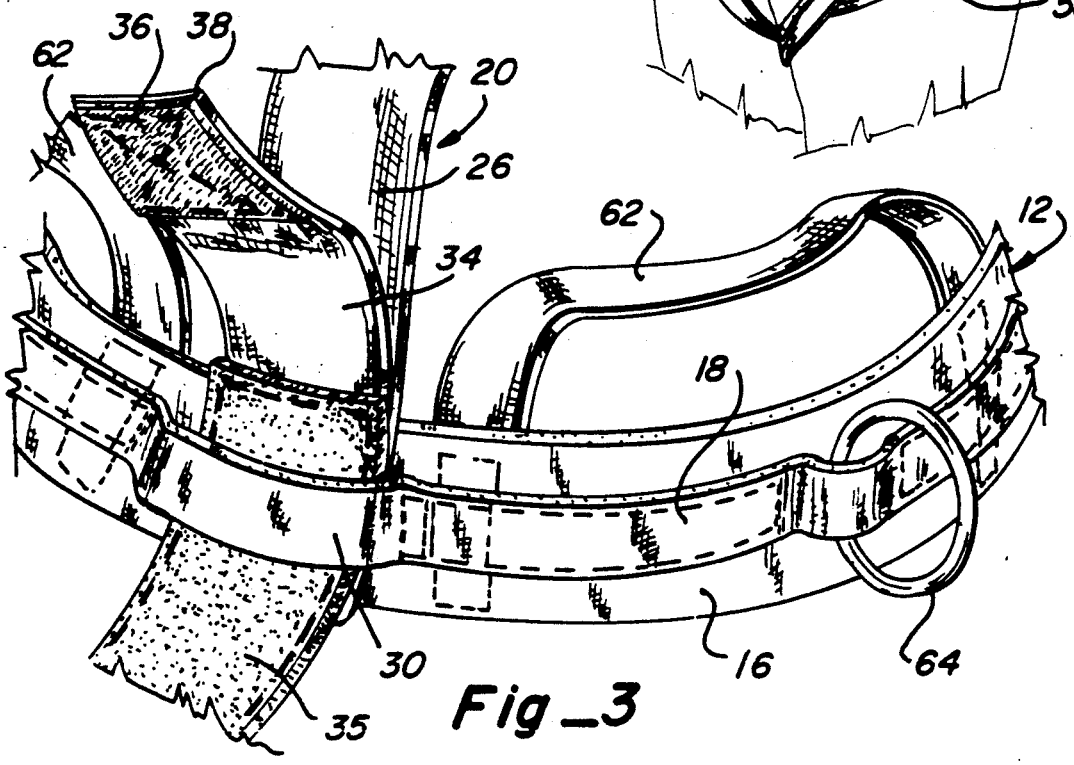
Fig_3

SPORTS HARNESS

BACKGROUND OF THE INVENTION

1. Field of the Invention

The present invention relates generally to body harnesses and more particularly to a body harness that is specifically adapted for use in training individuals to perform certain sports-related activities such as snow skiing.

2. Description of the Prior Art

Body harnesses of various types have been available for many years. By way of example, harnesses have been used on parachutes since the early years of aviation with an example of such a parachute harness being disclosed in U S. Pat. No. 3,692,262 issued to Gaylord. Body harnesses have also been used in mountain climbing so that an individual can be secured to a safety line in the event the individual loses his or her grip and falls during a mountain climbing venture. An example of such a harness is disclosed in U.S. Pat. No. 4,632,217 issued to Markwell, et al.

More recently, with the advent of seat belts in automobiles to protect individuals from harm upon sudden stops or wreckage of the automobile, body harnesses have been developed to be worn by small children or infants to prevent bodily harm to the infant. In some instances, the infant is confined in a car seat but in others, the infant can be secured in a body harness of the type disclosed in U.S. Pat. No. 3,954,280 issued to Roberts, et al.

Body harnesses have also been developed for small children so that they can be controlled in public places by attaching a tether to the body harness worn by the child whereby a parent can maintain continuous control over the child.

To applicant's knowledge, however, harnesses have not been used for training purposes in sports endeavors and it is to this end that the present invention has been developed.

SUMMARY OF THE INVENTION

The present invention relates specifically to a body harness that can be worn by a small child or by an adult and particularly a handicapped adult to assist in training the child or adult wearing the harness to perform certain athletic endeavors. A primary function of the harness is found in the sport of snow skiing where beginners frequently lose control and can cause great bodily harm to themselves and to others on the ski slope. Further, snow skiing has proven to be a very difficult sport to master and to assist in teaching or training an individual and particularly a small child or a handicapped individual to perform the sport, the harness of the present invention has been found to be very helpful.

The harness includes a hip strap adapted to extent horizontally around the hips of a user and a pair of shoulder straps that are connected at opposite ends to the hip strap at locations on the back and the front of the hip strap. Connection means are provided for interconnecting the shoulder straps along the back of the user and an adjustment means interconnects the shoulder straps across the chest of the user to assure that the shoulder straps remain in a proper position on the user of the harness.

Crotch straps are also provided with the opposite ends thereof operatively connected to the hip strap at locations on the back and front of the hip strap relative to the user. Longitudinally adjustable leg straps interconnect the crotch straps on each side of the user so as to maintain the crotch straps in position so that the hip strap does not ride or creep up on the individual during use.

In order to render the harness particularly useful for training in sports endeavors such as snow skiing, at least one handle is provided on the harness at the user's back so that the user can be assisted by a third party gripping the handle thereby maintaining control of the body movements of the user. The handle can also be used to help lift an individual onto a ski lift chair in appropriate circumstances. A plurality of the handles are provided in one embodiment of the invention for convenience purposes.

Gripping means similar to the handles are connected to the hip strap at locations on each side of the individual and at a location that is approximately centered on the individual's back again so that a third party can directly assist the individual using the harness in his or her sports activity.

In addition to the handles and gripping means by which a third party can directly assist an individual using the harness, attachment hooks or anchors are secured to the hip strap so that a tether line or lines can be connected to the harness to assist a third party in controlling a user's movements when learning certain sports such as snow skiing. In one embodiment of the invention, hooks or anchors are provided along the back side of the shoulder straps to facilitate attachment of the anchor to a sit ski which is used by handicapped individuals having weak upper-body strength.

Other aspects, features and details of the present invention can be more completely understood by reference to the following detailed description of the preferred embodiments, taken in conjunction with the drawings, and from the appended claims.

BRIEF DESCRIPTION OF THE DRAWINGS

FIG. 1 is a fragmentary perspective view of an individual wearing a first embodiment of the harness of the present invention as viewed from the front of the individual.

FIG. 2 is a fragmentary perspective view of an individual wearing the harness shown in FIG. 1 as viewed from the rear of the individual.

FIG. 3 is an enlarged fragmentary perspective view of a portion of the hip strap of the harness shown in FIG. 1 with various component parts connected thereto.

DETAILED DESCRIPTION OF THE PREFERRED EMBODIMENTS

Figure 4:
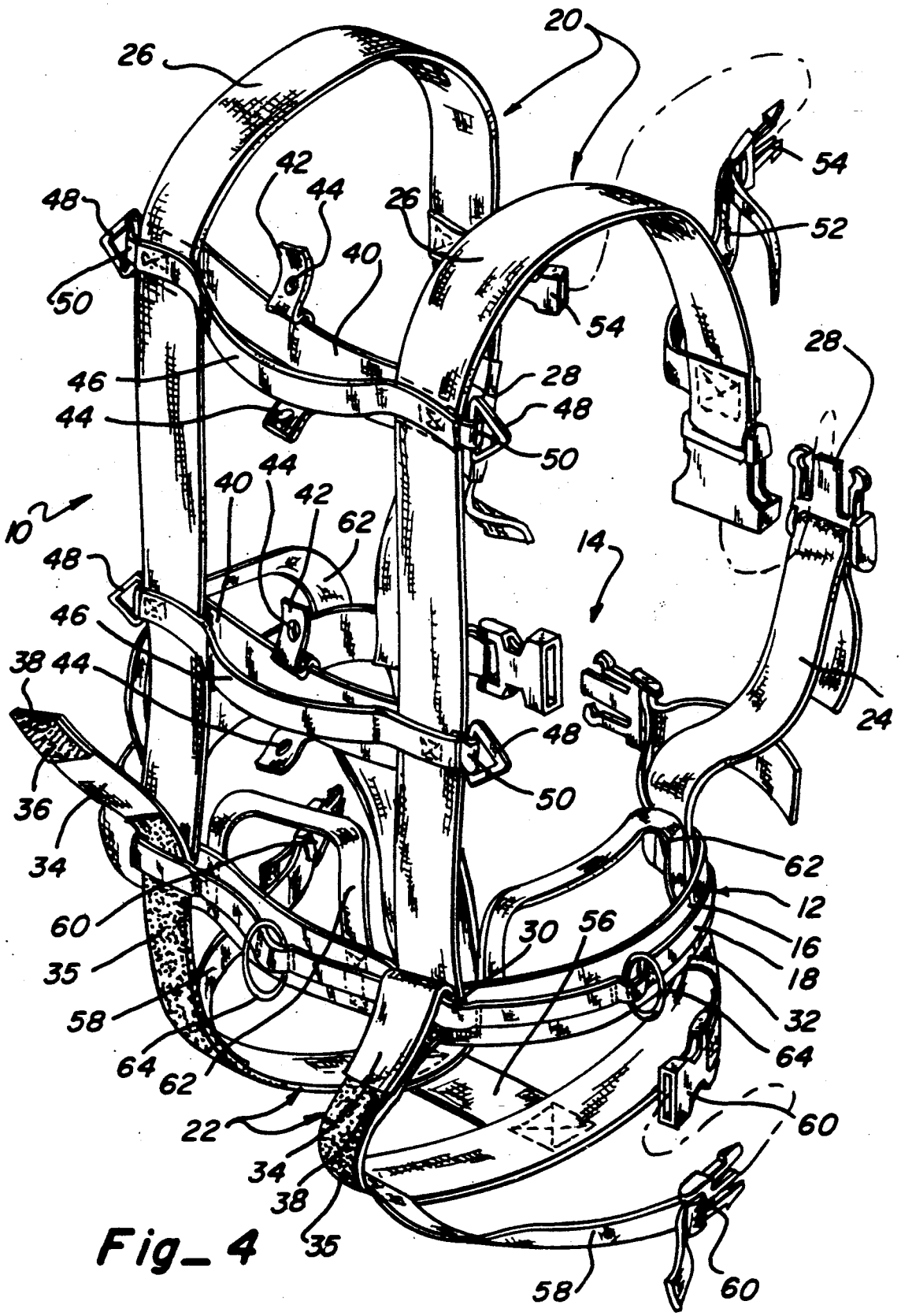
FIG. 4 is an enlarged perspective view of the harness shown in FIG. 1 as viewed from the back thereof.

With initial reference to FIGS. 1–4, the sports harness 10 of the present invention can be seen to be removably positionable on the upper torso of an individual 11. As will be appreciated with the description that follows, the main component straps of the harness have quick release connectors so that the harness can be readily put on and taken off for convenience purposes. It is also to be noted that in the preferred form of the invention, all of the strap components are made of conventional nylon webbing which is known to have adequate strength for the purpose intended.

The harness 10 includes as an anchor component thereof a hip strap 12 that is adapted to extend horizontally around the hips of the user. The hip strap includes a conventional quick release buckle-type fastener 14 at a centered location on the front of the harness with conventional means for varying the length of the hip strap so that it can be adjusted to tightly fit the hips of different sized users. The hip strap includes a main strap 16 and a relatively narrow auxiliary strap 18 sewn to the main strap in face-to-face relationship therewith on the outer surface thereof. The auxiliary strap 18 is only intermittently sewn to the main strap 16 so as to provide locations where other component parts of the harness can be secured to the hip strap as will be explained in more detail hereinafter.

A pair of shoulder straps 20 extend upwardly from the hip strap 12 and a pair of crotch straps 22 extend downwardly from the hip strap to positively position the harness on a user. The shoulder straps 20 actually consist of two component parts, a shoulder adjustment strap 24 and a main shoulder strap 26. The shoulder adjustment straps 24 are anchored in any suitable manner, such as by sewing, to the hip strap 12 at locations on either side of the buckle-type fastener 14 and actually extend downwardly beyond the hip strap for attachment to an associated crotch strap 22 as will become more clear hereinafter. The main shoulder straps 26 extend from the upper most extent of the shoulder adjustment straps 24, where they are releasably connected by a conventional buckle-type fastener 28, over the shoulders of the user and generally vertically down the user's back. The main shoulder straps pass through loops 30 provided on the hip strap (FIG. 3) between the main hip strap 16 and the auxiliary hip strap 18 and are thereafter continuous into the associated crotch straps. The continuous portion of the main shoulder strap which extends downwardly beyond the hip strap 12 and becomes the associated crotch strap extends at an inwardly directed angle beneath the crotch of the user and then extends forwardly around the front of the user's hip before being positively attached to the hip strap at a location 32 at the side of the user. A secondary strip webbing 34 has a length of Velcro ®-type fastening material 35 affixed to the outer surface thereof and the secondary strip is secured to the uppermost extent of an associated crotch strap 22 at the back of the harness. A mating piece of Velcro ® fastening material 36 is affixed to a free upper end 38 of the secondary strip 34 so that the free end of the secondary strip can be reversed over the auxiliary hip strap 18 for reattachment to itself through the Velcro ® fasteners. In this manner, the effective length of the crotch straps 22 can be varied to permit the harness to comfortably fit different sized users.

A pair of spacer straps 40 interconnect the main shoulder straps 26 at two vertically spaced locations along the back of the harness so that the shoulder straps will remain in a desired position on a user. Each spacer strap 40 has a flexible securement strap 42 affixed thereto that includes a releasable snap-type fastener 44 for a purpose which will be described later. The spacer straps are sewn or otherwise positively secured to the shoulder straps in a conventional manner.

Overlying the spacer straps 40 and also being connected to the main shoulder straps 26 are a pair of flexible handles 46 which are slightly longer in length than the spacer straps so that they protrude outwardly away from the user and can be easily gripped by an individual wanting to assist the user of the harness in a designated physical activity. When the handles are not in use, they can be secured to the adjacent spacer strap through use of the securement straps 42 described previously.

Also secured to the main shoulder straps 26 at the same location as the spacer straps 40 are a pair of triangular-shaped anchors 48 which are secured to the shoulder straps in any suitable manner such as by use of a piece 50 of webbing that is sewn directly to the shoulder strap. The triangular anchors 48 are made of a strong material and serve as an attachment means for anchoring the harness, while in use, to a sit ski (not shown). Sit skis are a unique form of toboggan used by handicapped individuals who have weak upper-body strength. A sit ski has an inverted u-shaped roll bar to which the harness can be releasably attached via the triangular anchors 48 by using any conventional attachment strap.

A chest adjustment strap 52 interconnects the main shoulder straps 26 at a front location overlying the chest of a user with the adjustment strap having two component parts, one anchored to each of the shoulder straps. The two component parts each have a component of a quick-release, buckle-type fastener 54 for securing the adjustment strap across the chest of the user. The length of the adjustment strap is adjustable in a conventional manner so that the spacing of the shoulder straps 26 can be adjusted for any individual user to assist in retaining the harness properly positioned on the user.

Referring again to the crotch straps 22, it will be appreciated that a short strip 56 of webbing (FIG. 4) interconnects the crotch straps at a location approximately midway along their length so as to lie immediately beneath the crotch of an individual using the harness. This strip 56 of webbing serves to hold the crotch straps in position so that they do not migrate relative to each other when the harness is in use. To also assist in this regard, a pair of leg straps 58 are anchored to the crotch straps near opposite ends of the crotch straps with each leg strap having two component parts secured to the crotch strap in any positive and secure manner. The component parts of the leg straps have components of a quick-release buckle 60 to secure the component parts of the straps 58. The length of each leg strap is adjustable in a conventional manner to fit various sized individuals.

Three gripping loops 62 are secured to the hip strap 12 at locations along each side of the harness 10 and at the center of the back of the harness. The gripping loops 62 provide a location where an individual can grip the harness to assist the user of the harness in a physical activity such as snow skiing. Accordingly, the gripping loops serve a similar function to the handles 46.

The auxiliary strap 18 that is secured to the outer surface of the main hip strap 16 also supports three oval anchors 64 at locations positioned on opposite sides of the harness and at the center of the back of the harness. The oval anchors serve as a point of attachment for a tether line or lines which will be described in more detail hereinafter.

The harness 10 is very easy to put on by merely putting one's legs downwardly through the openings defined by the crotch straps 22 and the hip strap 12 and then pulling the harness upwardly until the hip strap is in alignment with the hips of the user. The hip strap is securely buckled and adjusted in length so as to snugly fit the user's hips. The shoulder straps 20 are pulled over the shoulders and secured at the front of the user and again the length of the shoulder straps are adjusted in a conventional manner to pull the harness snugly onto the user's body. The chest adjustment strap 52 is secured and adjusted in length to assure that the shoulder straps will remain in position on the user's shoulders. Finally, the leg straps 58 are similarly connected around the outside of each thigh and adjusted in length to hold the crotch straps 22 in a positive position relative to the user's body.

In these simple steps, the harness is very positively positioned on the user's body so that another individual can assist the user of the harness by gripping any one of the gripping loops 62 or handles 46. It will be readily appreciated that the gripping loops and handles are easily deployed for being readily grabbed and due to the snug fit of the harness on the user's body, the movements of the user's body can be manipulated through the gripping loops and handles.

Particularly in activities such as snow skiing, due to the length of snow skis, it is sometimes beneficial to control the body movements of the user from a distal location. Accordingly, tether lines (not shown) can be attached to the harness 10 at any one of a plurality of locations to provide an assisting individual with the means for controlling the bodily movements of the user of the harness. By way of example, one tether could be connected at the center oval anchor 64 and this would allow the assisting individual to control the speed of the user of the harness by skiing behind the user to prevent the user from getting out of control. On the other hand, a pair of tethers could be connected to the oval anchors 64 on the opposite sides of the hip strap 12 so that by pulling and releasing the tethers the assisting individual could actually turn the body of the individual wearing the harness to assist in making turns and the like.

The handles 46 can be used not only in helping an individual while skiing, but can also be used to help the individual onto a chair lift by lifting the handle to lift the user's body onto a chair as the chair approaches.

Figure 5:
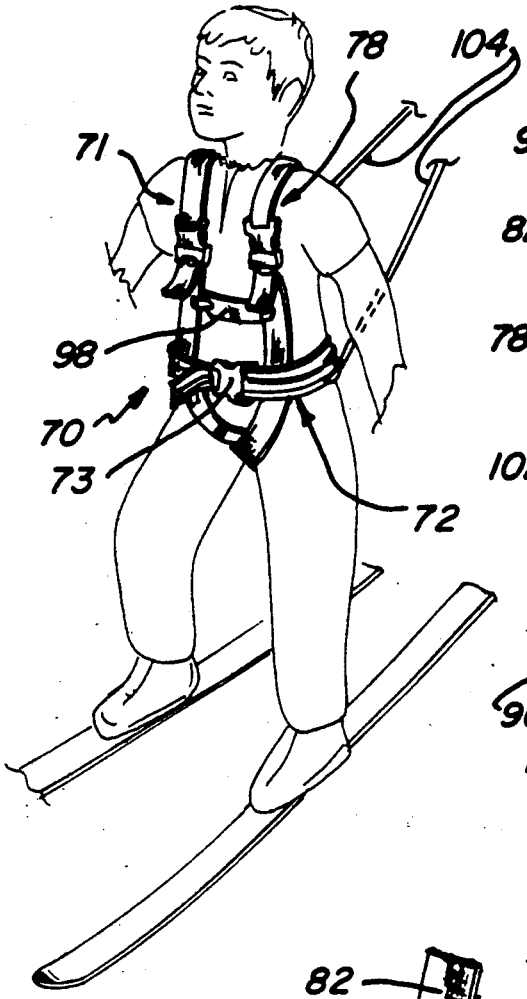
FIG. 5 is a fragmentary perspective view of a child wearing a second embodiment of the present invention as viewed from the front of the child.
Figure 6:
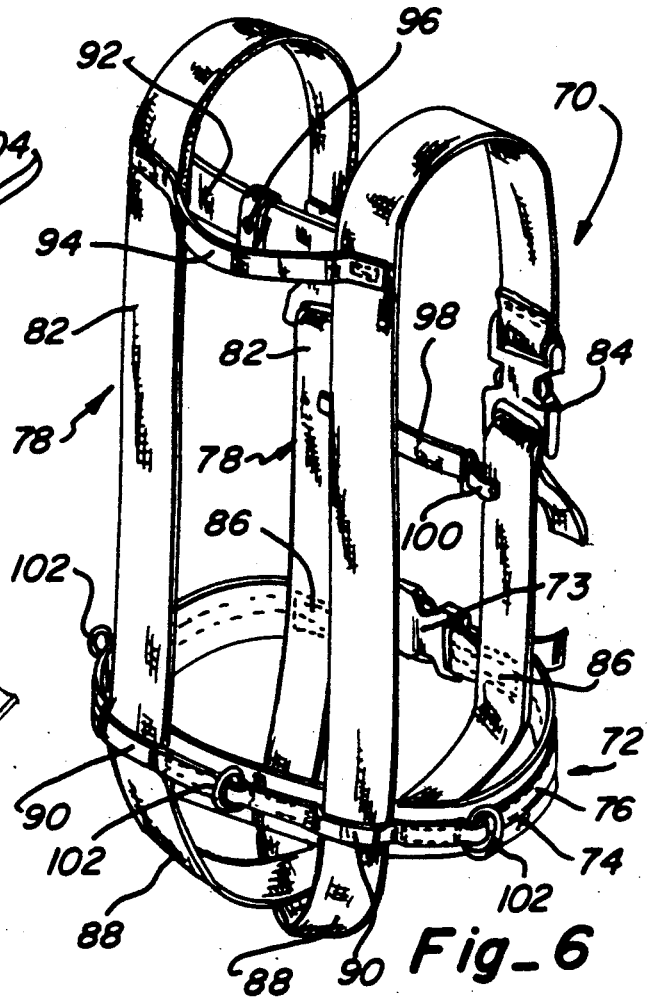
FIG. 6 is an enlarged perspective view of the embodiment of the harness shown in FIG. 5 as viewed from the back thereof.
Figure 7:
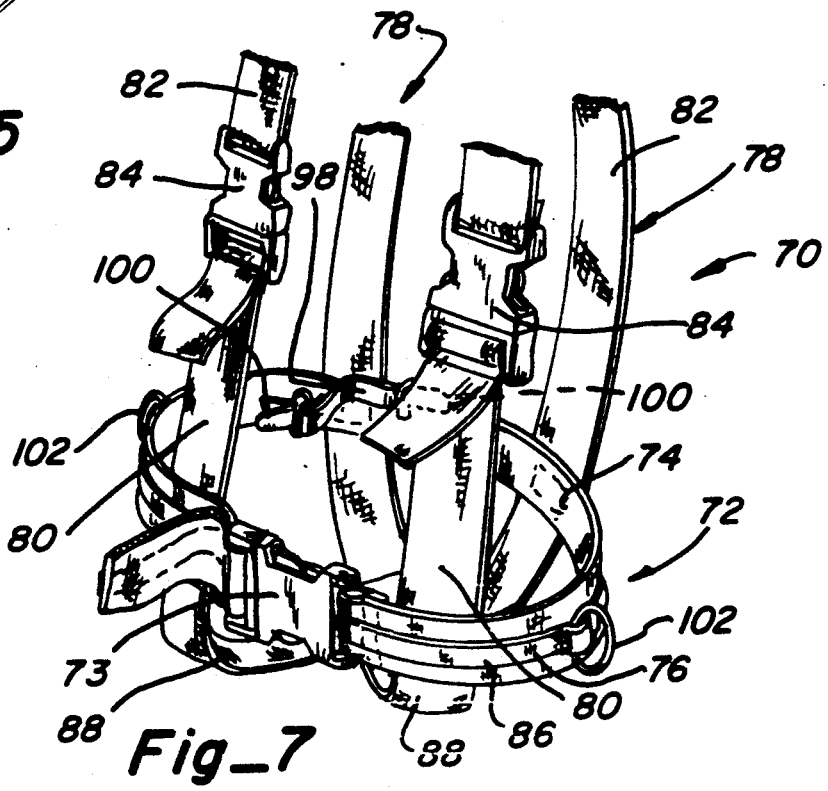
FIG. 7 is an enlarged fragmentary perspective view of the harness shown in FIG. 5 as viewed from the front thereof.

In an alternative embodiment 70 of the present invention which has been primarily designed for use with small children 71 and is illustrated in FIGS. 5–7, the design is somewhat simpler but yet incorporates the basic features of the first-described embodiment.

As in the first-described embodiment, each of the straps utilized is preferably made of a strong nylon webbing. The second-described embodiment which might be referred to as a child embodiment, has a hip strap 72 with a quick-release, buckle-type fastener 73 at the front and which includes a conventional adjustment feature to adjust the length of the hip strap to fit a given child. The hip strap includes a main strap 74 and a relatively narrow auxiliary strap 76 with the auxiliary strap being secured to the main strap as by stitching or the like in a manner to provide means for attaching other components of the harness to the hip strap.

A pair of shoulder straps 78 are operably connected to the tip strap 72 with the shoulder straps including a shoulder adjustment strap 80 and a main shoulder strap 82. The shoulder adjustment strap 80 is anchored at one end to the front of the hip strap 72 adjacent one side of the buckle-type fastener 73 and is adapted to extend upwardly along the chest of the child where it includes one part of a buckle fastener 84 on one end and means for adjusting the length of the shoulder adjustment strap 80. The main shoulder straps 82 share the other component of a buckle fastener 84 on one end for attachment to an associated shoulder adjustment strap and extend over the shoulder and down the back where they are slidably and operably connected to the hip strap 72 via spaces in the hip strap between the main hip strap 74 and the auxiliary hip strap 76. The main shoulder straps extend downwardly and rearwardly from the hip strap 72 in a diagonal direction so as cross each other at a location which is directly beneath the crotch of the child using the harness. After crossing, the shoulder straps are attached to the front of the hip strap in coinciding locations 86 with the attachment of the shoulder adjustment straps 80. In this manner, the main portion of the shoulder straps not only function as a shoulder strap per se but also as crotch straps 88 in crossing beneath the crotch of a user. In other words, the portion of the main shoulder straps that extend below the hip strap may be referred to as crotch straps. Loops 90 in the hip strap, through which the shoulder straps extend on the back side of the hip strap, are defined by the auxiliary strap 76 in an area where it is disconnected relative to the main hip strap 74.

A spacer strap 92 interconnects the shoulder straps 78 at a location on the back of the harness on or near the shoulder blades of the child. Overlying the spacer strap 92 is a handle strap 94 of slightly longer length than the spacer strap so as to protrude away from the spacer strap for ready gripping by an individual desiring to help the child in an activity such as skiing. A releasable securement strap 96 is secured to the spacer strap 92 and can be extended around the handle strap 94 to retain the handle strap in close proximity to the spacer strap when the handle strap is not being used.

The shoulder adjustment straps 80 are releasably connectable in spaced relationship across the chest of the user of the harness by a short length of webbing 98 having alligator clips 100 at opposite ends for easy connection and release to facilitate the ease with which the harness is placed on and removed from a child.

Three oval ring-type anchors 102 are secured to the hip strap 72 at opposite sides of the hip strap and at a centered location along the back of the hip strap by inserting the anchors between the auxiliary strap 76 and the main hip strap 74. These anchors are preferably metallic and strong in nature so that a tether line 104 can be releasably attached thereto to assist the child in skiing or in whatever other endeavor the child may be engaged.

As mentioned in regard to the first-described embodiment, a single tether could be connected to the anchor that is centered on the back of the hip strap or a pair of tethers can be attached to the anchors on the sides of the hip strap to assist in controlling body movements of the child thereby facilitating the child's ability to learn to snow ski.

Although the present invention has been described with a certain degree of particularity, it is understood that the present disclosure has been made by way of example, and changes in detail or structure may be made without departing from the spirit of the invention, as defined in the appended claims.

I claim:

1. A harness adapted to be worn by a sports participant comprising, a releasable hip strap extending substantially horizontally in a closed loop completely around the hips of a user, a pair of shoulder straps connected to the hip strap at a front and rear location relative to a user and adapted to extend over a user's shoulders, connection means operably interconnecting the shoulder straps at the back of a user, chest adjustment means interconnecting the shoulder straps at the chest of a user, a pair of crotch straps having opposite ends connected to the hip strap at a front and rear location relative to a user and adapted to pass beneath a user's crotch, and a handle means connected to said shoulder straps adjacent to the neck of a user and being of a size to be easily gripped by the full hand of a third party.

2. The harness of claim 1 wherein there are a plurality of said handle means vertically spaced along the back of a user.

3. The harness of claim 2 wherein said handle means are comprised of flexible straps secured to said shoulder straps and extending therebetween in a non-tensioned manner.

4. The harness of claim 1 wherein said handle means is comprised of a flexible strap secured to said shoulder straps and extending therebetween in a non-tensioned manner.

5. The harness of claim 1 further including gripping means in the form of a loop secured to said hip strap and protruding therefrom for ready access.

6. The harness of claim 5 wherein there are a plurality of said gripping means and wherein one of said gripping means is centered at the back of the hip strap and a pair of said gripping means are disposed at the sides of the user.

7. The harness of claim 1 wherein said handle means and said connection means are connected to the shoulder straps at the same locations along the length of the shoulder straps.

8. The harness of claim 7 further including a plurality of said connection means at vertically spaced locations along the length of said shoulder straps and wherein said handle means and said connection means are connected to the shoulder straps at the same locations along the length of the shoulder straps.

9. The harness of claim 1 further including a plurality of anchor means along said shoulder straps adapted for use in securing the harness to sproting equipment.

10. A harness adapted to be worn by a sports participant comprising, a releasable hip strap extending substantially horizontally around the hips of a user, a pair of shoulder straps connected to the hip strap at a front and rear location relative to a user and adapted to extend over a users shoulders, connection means interconnecting the shoulder straps at at least one location, a pair of crotch straps connected at opposite ends to said hip strap and adapted to pass beneath a user's crotch, and leg strap means attached to each crotch strap at a location on the front of a user and at a location on the back of a user, said leg straps serving to hold the crotch straps in position on a user thereby preventing the hip strap from creeping up on the user.

11. The harness of claim 10 wherein said leg straps are adjustable in length.

12. A harness adapted to be worn by a sport's participant comprising, a releasable hip strap extending substantially horizontally in a dose loop completely around the hips of a user, a pair of shoulder strap connected to the hip strap at a front and rear location relative to a user and adapted to extend over a suer's shoulders, connection means interconnecting the shoulder straps at the back of a user, chest adjustment means interconnecting the shoulder strap at the chest of a user, a pair of crotch straps having opposite ends connected to the hip strap at a front and rear location relative to a user and adapted to pass beneath a user's crotch, a handle means connected to said shoulder straps adjacent to a neck of a user, and an attachment ring positively secured to said hip strap at a substantially centered position relative to the back of a user to which a tether can be connected.

13. The harness of claim 12 further including additional attachment rings secured to said hip strap at opposite sides of the user.

14. The harness of claim 13 further including connection means secured to said shoulder straps along the back of a user.

* * * * *